US007997710B2

(12) United States Patent
Umeda

(10) Patent No.: US 7,997,710 B2
(45) Date of Patent: Aug. 16, 2011

(54) LIQUID SUPPLY APPARATUS AND LIQUID DISCHARGE APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 805 days.

(21) Appl. No.: 12/058,357

(22) Filed: Mar. 28, 2008

(65) Prior Publication Data

US 2008/0239041 A1 Oct. 2, 2008

(30) Foreign Application Priority Data

Mar. 30, 2007 (JP) ..... 2007-091995

(51) Int. Cl.
*B41J 2/19* (2006.01)

(52) U.S. Cl. ..... 347/92; 347/86; 347/93

(58) Field of Classification Search ..... 347/84–87, 347/92–94

See application file for complete search history.

(56) References Cited

U.S. PATENT DOCUMENTS

| | | | | |
|---|---|---|---|---|
| 4,771,295 | A * | 9/1988 | Baker et al. | 347/87 |
| 6,540,321 | B1 * | 4/2003 | Hirano et al. | 347/22 |
| 7,004,207 | B2 * | 2/2006 | Finkelshtain et al. | 141/2 |
| 7,407,275 | B2 * | 8/2008 | Inoue et al. | 347/86 |
| 2001/0040610 | A1 * | 11/2001 | Kurata et al. | 347/85 |
| 2003/0052951 | A1 * | 3/2003 | Ujita et al. | 347/86 |
| 2003/0160848 | A1 * | 8/2003 | Taniguchi et al. | 347/86 |
| 2006/0203047 | A1 | 9/2006 | Koga et al. | |

FOREIGN PATENT DOCUMENTS

| | | | |
|---|---|---|---|
| JP | 2004009450 | A | 1/2004 |
| JP | 2006247936 | A | 9/2006 |

* cited by examiner

*Primary Examiner* — Ellen Kim

(74) *Attorney, Agent, or Firm* — Baker Botts L.L.P.

(57) ABSTRACT

Inks are supplied from ink inflow flow passages to ink storage chambers in a subtank. The inks are further supplied from the ink storage chambers via ink outflow flow passages to a head. The ink storage chambers are stacked in the vertical direction, with upper surfaces or lower surfaces thereof being defined by damper films respectively. Parts of upper surfaces of the ink inflow flow passages and parts of upper surfaces of the ink outflow flow passages are defined by gas-permeating films. The gas, which is contained in the liquids in the ink inflow flow passages and the ink outflow flow passages, is discharged via the gas-permeating film to a gas discharge passage. The gas is prevented from the outflow together with the liquids from the liquid supply apparatus.

15 Claims, 10 Drawing Sheets

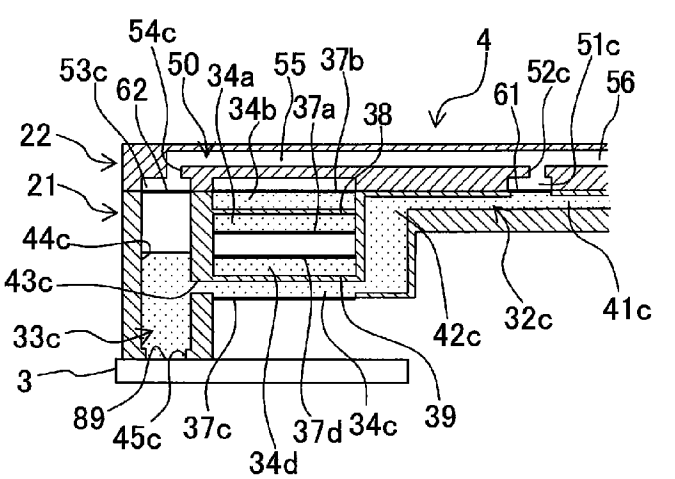
Fig. 5C
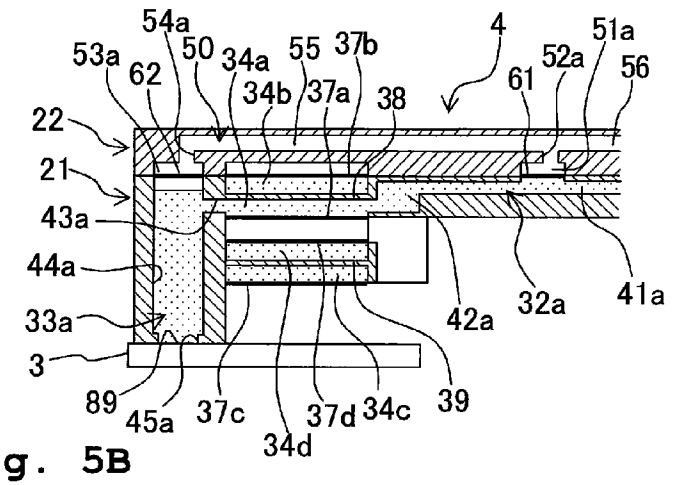
Fig. 5A
Fig. 5D
Fig. 5B

LIQUID SUPPLY APPARATUS AND LIQUID DISCHARGE APPARATUS

CROSS REFERENCE TO RELATED APPLICATION

The present application claims priority from Japanese Patent Application No. 2007-091995, filed on Mar. 30, 2007, the disclosure of which is incorporated herein by reference in its entirety.

BACKGROUND OF THE INVENTION

1. Field of the Invention

The present invention relates to a liquid supply apparatus which supplies a liquid and a liquid discharge apparatus which discharges a liquid from a nozzle.

2. Description of the Related Art

In a certain ink-jet head for discharging a ink from a nozzle, the ink is supplied from a subtank (liquid supply apparatus) provided between an ink cartridge and an ink-jet head. For example, in an ink-jet recording apparatus described in Japanese Patent Application Laid-open No. 2006-247936, an ink-jet head and a subtank are arranged on a carriage, and the ink is supplied from the subtank to the ink-jet head. An atmospheric air communication hole is provided on the upper surface of the subtank. The atmospheric air communication hole is covered with a gas-permeating film. Accordingly, the gas contained in the subtank is discharged from the atmospheric air communication hole to the outside. Therefore, the liquid contained in the subtank can be separated from the gas. It is possible to avoid any invasion of the gas into the ink-jet head.

In the ink-jet head recording apparatus described in Japanese Patent Application Laid-open No. 2006-247936, the carriage makes the reciprocating movement in the predetermined directions. Therefore, the pressure fluctuation arises in the ink contained in the subtank. It is feared that the discharge characteristic of the ink may be varied or fluctuated in the ink-jet head due to the pressure fluctuation. On the contrary, the present inventors have contrived that a damper film is provided for a subtank in order to suppress the pressure fluctuation of the ink as described above. Further, the present inventors have made the following investigation. In order to sufficiently absorb the pressure fluctuation of the ink in the subtank, it is necessary that the areal size of the damper film should be increased. However, if a damper film having a large areal size is provided for the subtank, then the areal size of the gas-permeating film is decreased to an extent corresponding thereto, and it is feared that the gas contained in the subtank cannot be discharged sufficiently. As a result, the gas flows into the ink-jet head together with the ink. It is feared that the discharge characteristic of the ink may be fluctuated in the ink-jet head. On the other hand, if it is intended to increase both of the areal sizes of the damper film and the gas-permeating film, the subtank consequently has a large size.

SUMMARY OF THE INVENTION

An object of the present invention is to provide a liquid supply apparatus which is capable of sufficiently discharging, to the outside, the gas contained in the liquid to be supplied, without allowing the liquid supply apparatus to have a large size, and a liquid discharge apparatus which is provided with such a liquid supply apparatus.

According to a first aspect of the present invention, there is provided a liquid supply apparatus which supplies a liquid to an object, the liquid supply apparatus including:

a plurality of liquid storage chambers which are stacked in a predetermined direction;

a plurality of damper films each of which defines one surface of an upper surface and a lower surface of one of the liquid storage chambers in the predetermined direction and each of which suppresses a pressure fluctuation of the liquid contained in the one of liquid storage chambers;

a plurality of liquid inflow passages each of which is communicated with one of the plurality of liquid storage chambers and through each of which the liquid flows into one of the plurality of liquid storage chambers;

a plurality of liquid outflow passages each of which is communicated with one of the liquid storage chambers and through each of which the liquid contained in one of the liquid storage chambers flows toward the object;

a gas discharge passage which is arranged on one side in the predetermined direction of the liquid storage chambers and via which a gas contained in each of the plurality of liquid inflow passages and the plurality of liquid outflow passages is discharged;

a sucking mechanism which sucks the gas contained in the gas discharge passage to discharge the gas to outside of the gas discharge passage;

a plurality of first gas-permeating films each of which partially defines one of the liquid inflow passages and through which only the gas is passable; and a plurality of second gas-permeating films each of which partially defines one of the liquid outflow passages and through which only the gas is passable, wherein the gas discharge passage and each of the liquid inflow flow passages are communicated with each other via one of the first gas-permeating films, and the gas discharge passage and each of the liquid outflow passages are communicated with each other via one of the second gas-permeating films.

In this case, the liquid inflow passages are communicated with the gas discharge passage via the first gas-permeating films. Therefore, the gas contained in the liquid inflow passages is discharged to the gas discharge passage. Further, the liquid outflow passages are communicated with the gas discharge passage via the second gas-permeating films. Therefore, the gas contained in the liquid outflow passages is discharged to the gas discharge passage. In this way, the gas can be discharged to the gas discharge passage from both of the liquid inflow passages and the liquid outflow passages. Therefore, it is possible to discharge a sufficient amount of the gas. The gas can be reliably separated from the liquid allowed to flow into/from the liquid storage chambers. Further, the gas-permeating films do not define the liquid storage chamber. Therefore, it is possible to sufficiently secure the areal size of the damper films each of which defines or establishes one of the liquid storage chambers. It is possible to sufficiently attenuate the pressure fluctuation in the liquid storage chamber. The gas-permeating films, through which only the gas is permeated, means, for example, the films through which only the gas can be permeated, but the liquid, the solid, and minute particles and the like dispersed in the liquid cannot be permeated therethrough.

In the liquid supply apparatus of the present invention, the predetermined direction may be a vertical direction, and the gas discharge passage may be arranged above the liquid storage chambers. In this case, the gas discharge passage is arranged over or above the liquid storage chambers. Therefore, when the liquid supply apparatus is arranged on the horizontal surface, then the gas is easily directed to the gas discharge passage, and it is possible to discharge the gas with ease.

In the liquid supply apparatus of the present invention, the liquid inflow passages may have close portions which extend in a direction and are arranged closely to each other on a same plane, and separate portions which are continued from the close portion respectively but arranged to be separate and away from each other and which are connected to the liquid storage chambers respectively; and each of the first gas-permeating films may define one of the liquid inflow passages at one of the close portions of the liquid inflow passages. In this case, for example, one sheet of the gas-permeating films can be used to define the walls of the close portions (convergent portions) of the plurality of liquid inflow passages. It is possible to reduce the production cost of the liquid supply apparatus.

In the liquid supply apparatus of the present invention, the plurality of liquid outflow passages may have separate portions which extend from the liquid storage chambers respectively in a state that the separate portions are separated and away from each other, and close portions which are continued from the separate portions respectively and which extend in a direction and are arranged closely to each other on a same plane; and each of the second gas-permeating films may define one the liquid outflow passages at one of the close portions of the liquid outflow passages. In this case, for example, one sheet of the gas-permeating film can be used to define the walls of the convergent portions of the plurality of liquid outflow passages. It is possible to reduce the production cost of the liquid supply apparatus.

In the liquid supply apparatus of the present invention, the first gas-permeating films and the second gas-permeating films may be provided on a same plane. In this case, it is easy to attach the first gas-permeating film and the second gas-permeating film.

In the liquid supply apparatus of the present invention, an uppermost liquid storage chamber, which is included in the plurality of liquid storage chambers and which is positioned at an uppermost position in the vertical direction, may have an upper surface defined by one of the damper films, and the damper film may be provided on the same plane as that of the first gas-permeating films and the second gas-permeating films. In this case, the damper film is also positioned on the same plane in addition to the first gas-permeating films and the second gas-permeating films. Therefore, it is easy to attach these components.

According to a second aspect of the present invention, there is provided a liquid discharge apparatus which discharges a liquid, the liquid discharge apparatus including:

a head having a plurality of nozzles through which the liquid is discharged;

a plurality of cartridges in each of which the liquid is filled to be supplied to the head; and a liquid supply section which supplies the liquid to the head from each of the plurality of cartridges, the liquid supply section including:

a plurality of liquid storage chambers which are stacked in a predetermined direction;

a plurality of damper films each of which defines one surface of an upper surface and a lower surface of one of the liquid storage chambers in the predetermined direction and each of which suppresses a pressure fluctuation of the liquid contained in one of the liquid storage chambers;

a plurality of liquid inflow passages each of which is communicated with one of the liquid cartridges and one of the liquid storage chambers, and through each of which the liquid filled in one of the liquid cartridges flows into one of the liquid storage chambers;

a plurality of liquid outflow passages each of which is communicated with the head and one of the liquid storage chambers and through each of which the liquid contained in one of the liquid storage chambers flows to the head;

a gas discharge passage which is arranged on one side in the predetermined direction of the liquid storage chambers and via which a gas contained in each of the liquid inflow passages and each of the liquid outflow passages is discharged;

a sucking mechanism which sucks the gas contained in the gas discharge passage to discharge the gas to outside of the gas discharge passage;

a plurality of first gas-permeating films each of which partially defines one of the liquid inflow passages and through each of which only the gas is passable; and a plurality of second gas-permeating films each of which partially defines one of the liquid outflow passages and through each of which only the gas is passable, wherein the gas discharge passage and each of the liquid inflow passages are communicated with each other via one of the first gas-permeating films; and the gas discharge passage and each of the liquid outflow passages are communicated with each other via one of the second gas-permeating films.

According to the second aspect of the present invention, the liquid inflow passages are communicated with the gas discharge passage via the first gas-permeating films. The gas contained in the liquid inflow passages is discharged to the gas discharge passage. Further, the liquid outflow passages are communicated with the gas discharge passage via the second gas-permeating films. Therefore, the gas contained in the liquid outflow passages is discharged to the gas discharge passage. In this way, the gas can be discharged to the gas discharge passage from both of the liquid inflow passages and the liquid outflow passages. Therefore, it is possible to discharge a sufficient amount of the gas. The gas can be reliably separated from the liquid allowed to inflow/outflow into/from the liquid storage chambers. The liquid discharge head is prevented from any invasion of the gas which would otherwise cause any harmful influence on the discharge characteristic. Further, the gas-permeating films do not define the liquid storage chambers. Therefore, it is possible to sufficiently secure the areal size of the damper film which defines or establishes the liquid storage chambers. It is possible to sufficiently attenuate the pressure fluctuation in the liquid storage chamber. Therefore, the pressure fluctuation, which is generated in the liquid contained in the liquid storage chamber, can be reliably suppressed. It is possible to avoid any deterioration of the discharge characteristic which would be otherwise caused by the pressure fluctuation.

In the liquid discharge apparatus of the present invention, the predetermined direction may be a vertical direction, and the gas discharge passage may be arranged over or above the plurality of liquid storage chambers. In this case, when the liquid discharge apparatus is arranged on the horizontal surface, then the gas is easily directed to the gas discharge passage, and the gas can be discharged with ease, because the gas discharge passage is arranged over or above the liquid storage chambers.

In the liquid discharge apparatus of the present invention, the liquid supply section may be fixed to the head; and the liquid discharge apparatus may further includes a reciprocating mechanism which causes the liquid discharge head to reciprocate in parallel to a horizontal plane. In this case, when the liquid supply section is subjected to the reciprocating movement together with the head by means of the reciprocating mechanism, the pressure fluctuation arises in the liquid in the liquid storage chamber. However, the pressure fluctuation can be suppressed by means of the damper films.

In the liquid discharge apparatus of the present invention, the liquid may be an ink, and the liquid discharge apparatus may further include a liquid discharge passage through which the ink contained in the head is discharged; and a switching mechanism which selectively switches the sucking mechanism between a first state in which the sucking mechanism is connected to the gas discharge passage and a second state in which the sucking mechanism is connected to the liquid discharge passage. In this case, when the liquid discharge passage, through which the liquids contained in the head are discharged, is provided in the liquid discharge apparatus, the sucking mechanism, which is provided in order to suck the gas contained in the gas discharge passage, can be also used as the sucking mechanism for sucking the liquids contained in the liquid discharge head. Accordingly, it is unnecessary to provide separate or distinct sucking mechanisms therefor. It is possible to simplify the structure of the entire apparatus.

In the liquid discharge apparatus of the present invention, the liquid outflow flow passages may be connected to the head in a direction parallel to the horizontal plane. In this case, when the head is moved in the horizontal direction, the liquid contained in the liquid outflow passage is allowed to inflow/outflow into/from the head in accordance with the inertial force. In this situation, the fluctuation arises in the pressure of the liquid contained in the head. However, the pressure fluctuation can be suppressed by means of the damper films.

BRIEF DESCRIPTION OF THE DRAWINGS

FIG. 5 shows sectional views illustrating those shown in FIG. 2, wherein FIG. 5A shows a sectional view taken along a line A-A, FIG. 5B shows a sectional view taken along a line B-B, FIG. 5C shows a sectional view taken along a line C-C, and FIG. 5D shows a sectional view taken along a line D-D.

DESCRIPTION OF THE PREFERRED EMBODIMENTS

A preferred embodiment of the present invention will be explained below.

Figure 1:
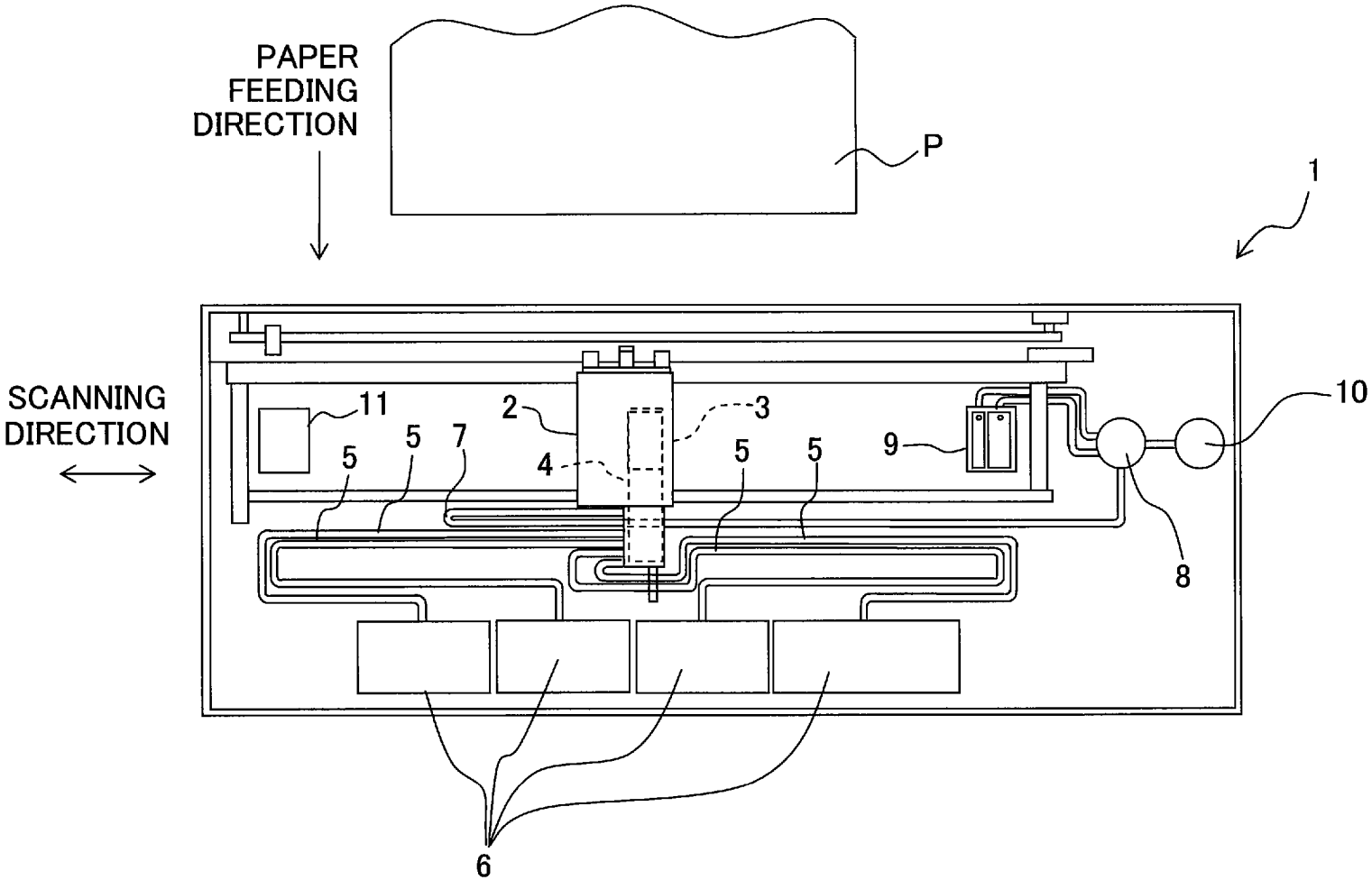
FIG. 1 shows a schematic structure of a printer according to an embodiment of the present invention.

FIG. 1 shows a schematic structure illustrating a schematic arrangement when a printer according to the embodiment of the present invention is viewed from an upper position. As shown in FIG. 1, the printer 1 (liquid discharge apparatus) includes, for example, a carriage 2 (reciprocating movement mechanism), an ink-jet head 3 (liquid discharge head), a subtank 4 (liquid supply apparatus), four tubes 5, four ink cartridges 6, a tube 7, a switching unit 8, a suction cap 9, a suction pump 10, and an ink-receiving section 11.

The carriage 2 makes the reciprocating movement in the left-right direction (scanning direction) as shown in FIG. 1. The carriage 2 is moved in parallel to the horizontal surface. The ink-jet head 3 is arranged on the lower surface of the carriage 2. The ink-jet head 3 makes the reciprocating movement in the scanning direction together with the carriage 2, while the inks are discharged from nozzles 95 (see FIG. 6) formed on the lower surface thereof.

The subtank 4 is arranged on the upper surface of the ink-jet head 3. The subtank 4 supplies the inks to the ink-jet head 3. One end of each of the four tubes 5 is connected to the subtank 4 from the left side as shown in FIG. 1, and the other end is connected to each of the four ink cartridges 6. The four tubes 5 makes communication between the ink cartridges 6 and ink inflow flow passages 32*a* to 32*d* of the subtank 4 as described later on (see FIG. 2).

The four ink cartridges 6 are filled with the inks of black, yellow, cyan, and magenta in this order from those arranged on the left side as shown in FIG. 1. The inks, which are charged in the four ink cartridges 6, are supplied to the subtank 4 via the tubes 5. The four color inks are discharged from the ink-jet head 3.

In the printer 1, the recording paper P is transported in the downward direction (paper feeding direction) as shown in FIG. 1, for example, by means of unillustrated recording paper transport rollers. The inks are discharged from the ink-jet head 3 which makes the reciprocating motion together with the carriage 2, and thus the printing is performed on the recording paper P.

One end of the tube 7 is connected to the subtank 4, and the other end is connected to the switching unit 8. A gas discharge passage 50 (a gas discharge passage 50) of the subtank 4 described later on (see FIG. 2) is communicated with the suction pump 10 via the switching unit 8. The switching unit 8 is connected to the tube 7, the suction cap 9, and the suction pump 10. The switching unit 8 is capable of selectively switching any one of the first state in which the suction pump 10 and the tube 7 are connected to one another and the second state in which the suction pump 10 and the suction cap 9 are connected to one another.

The suction cap 9 is arranged at the position overlapped with the vicinity of the right end in the drawing in the range in which the carriage 2 is movable in the scanning direction as viewed in a plan view. The suction cap 9 is moved in the upward direction (in the frontward direction in the plane of paper of FIG. 1) to cover the lower surface of the ink-jet head 3 therewith, when the carriage 2 is moved in the scanning direction and the ink-jet head 3 arrives at the position opposed to the suction cap 9. Accordingly, the nozzles 95 (see FIG. 6) are covered with the suction cap 9. In this state, the inks contained in the ink-jet head 3 are sucked from the nozzles 95 by means of the suction pump 10.

The suction pump 10 is selectively connected to the tube 7 or the subtank 4 by the switching unit 8. When the suction pump 10 and the tube 7 are connected to one another by the switching unit 8, the suction pump 10 sucks the gas contained in the tube 7 to lower the pressure in the tube 7 and the gas discharge passage 50 communicated with the tube 7 (see FIG. 2). On the other hand, when the suction pump 10 and the suction cap 9 are connected to one another by the switching unit 8, the suction pump 10 lowers the gas pressure in the space surrounded by the ink-jet head 3 and the suction cap 9 in the state in which the lower surface of the ink-jet head 3 is covered with the suction cap 9 so that the inks contained in the ink-jet head 3 are sucked from the nozzles 95 (see FIG. 6).

As described above, the printer 1 is provided with the switching unit 8. The switching unit 8 can be used to selectively switch the first state in which the suction pump 10 and the tube 7 are connected to one another and the second state in which the suction pump 10 and the suction cap 9 are connected to one another. When the switching operation is performed by means of the switching unit 8 as described above, the suction pump 10 can be used in both of the ways of use, i.e., the suction of the air contained in the tube 7 and the suction of the inks contained in the ink-jet head 3. Therefore, it is unnecessary to distinctly or separately provide pumps for the ways of use.

The ink-receiving section 11 is arranged at the position overlapped with the vicinity of the left end in the drawing in the area in which the carriage 2 is movable in the scanning direction as viewed in a plan view. The ink-receiving section 11 has, for example, an absorbing member or absorber. The ink-receiving section 11 is capable of receiving the inks discharged from the ink-jet head 3 when the flashing process is performed during the printing. When the flashing process is performed, the inks are discharged from the nozzles 95 (see FIG. 6) of the ink-jet head 3 when the carriage 2 is moved in the scanning direction and the ink-jet head 3 arrives at the position opposed to the ink-receiving section 11. Accordingly, the inks are prevented from being dried in the nozzles 95 which have few discharge opportunities.

Figure 2:
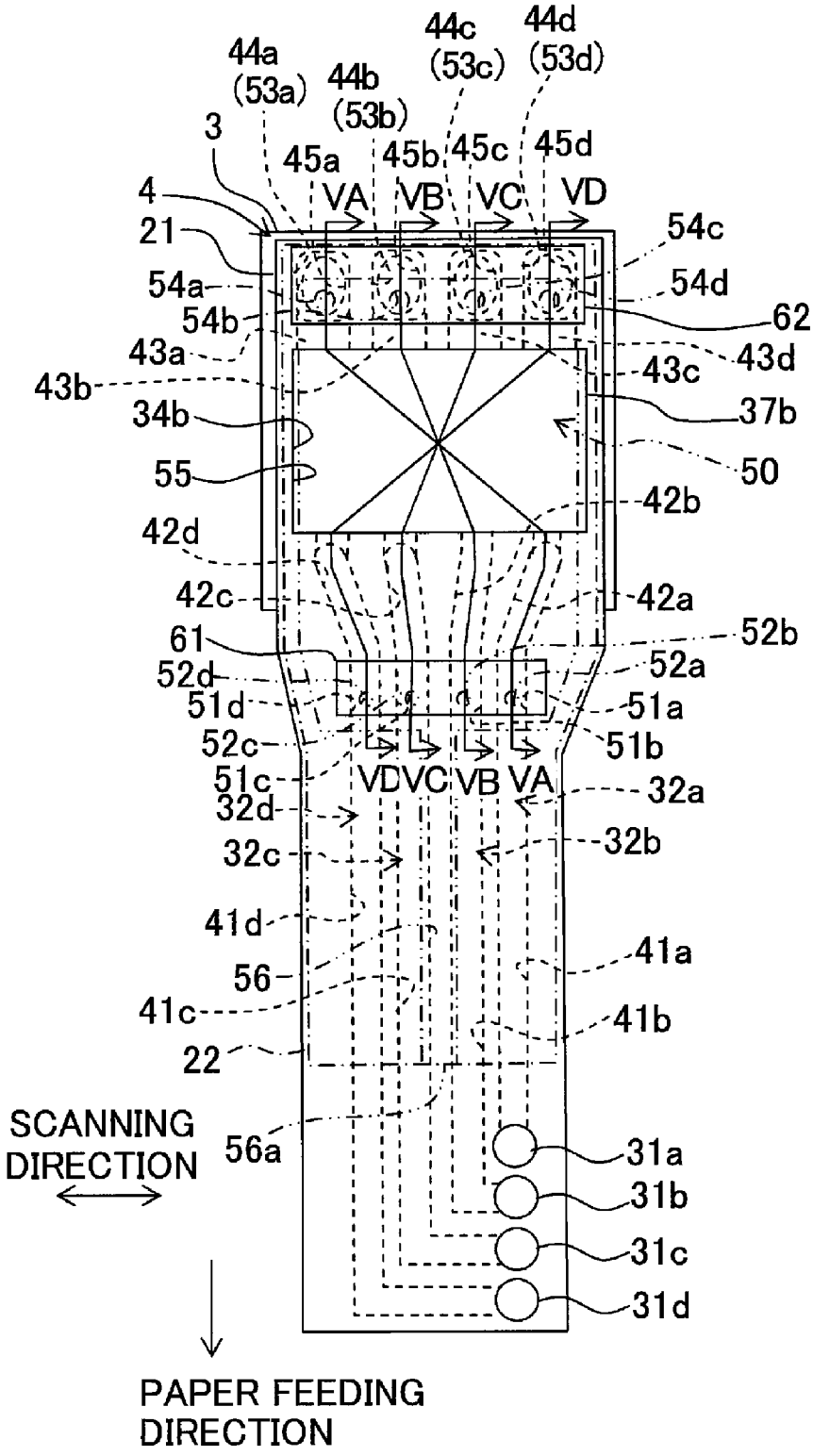
FIG. 2 shows a plan view illustrating a subtank shown in FIG. 1.
Figure 3:
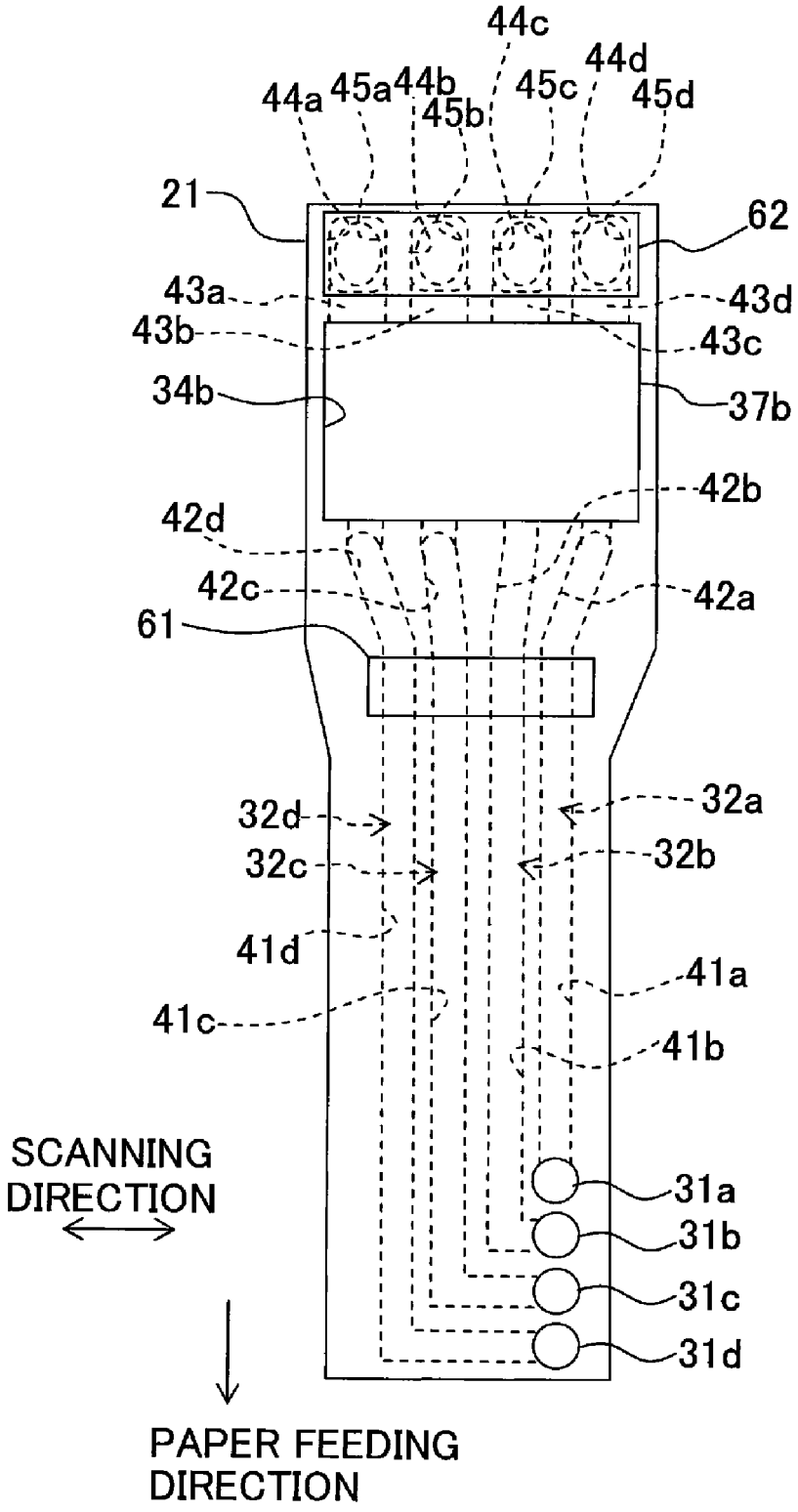
FIG. 3 shows a plan view illustrating a flow passage member shown in FIG. 2.
Figure 4:
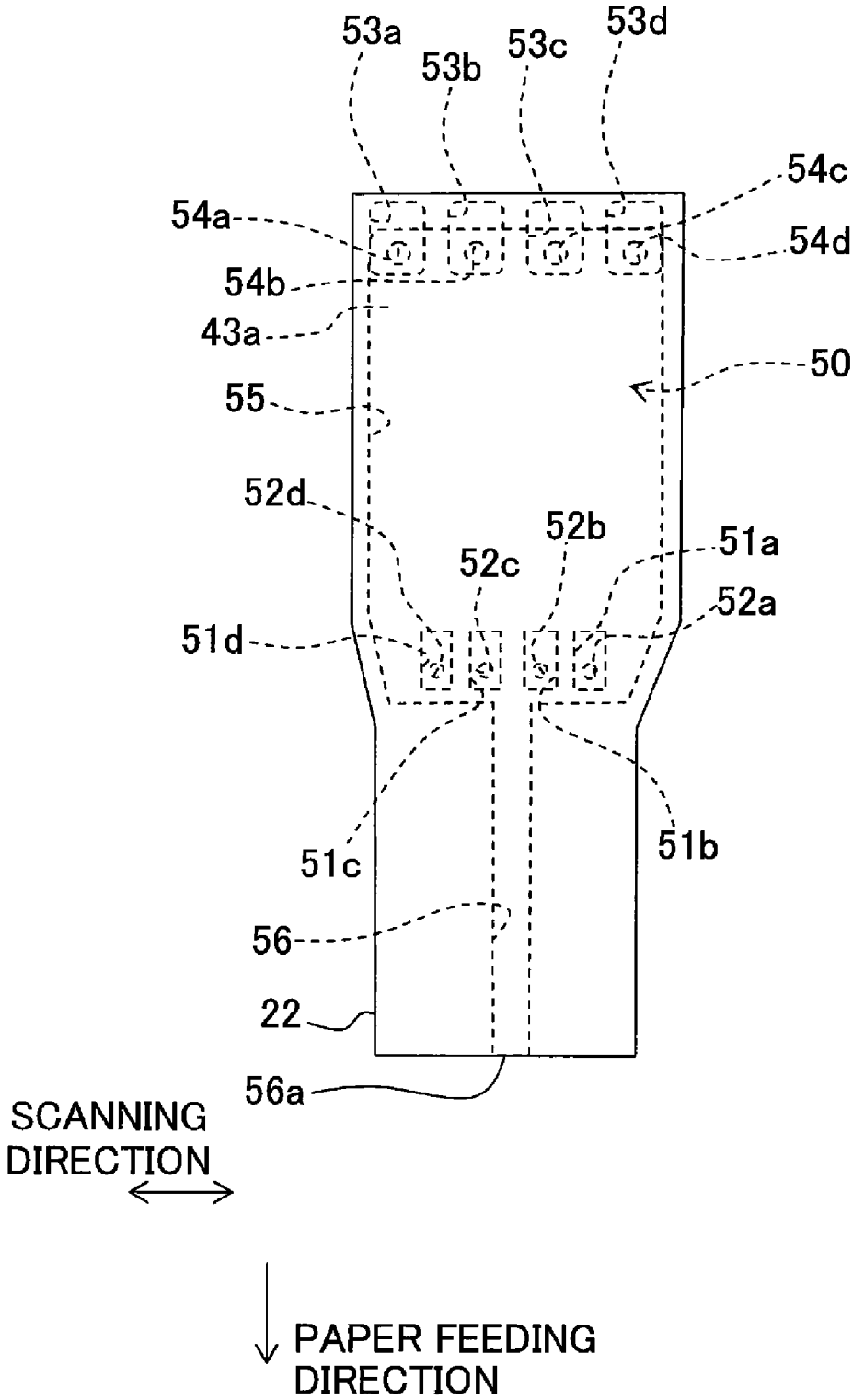
FIG. 4 shows a plan view illustrating a gas discharge member shown in FIG. 2.

Next, the subtank 4 will be explained in detail. FIG. 2 shows a plan view illustrating the subtank 4 shown in FIG. 1. FIG. 3 shows a plan view illustrating a flow passage member shown in FIG. 2. FIG. 4 shows a plan view illustrating a gas discharge member shown in FIG. 2. FIGS. 5A, 5B, 5C, and 5D show a sectional view taken along a line VA-VA shown in FIG. 2, a sectional view taken along a line VB-VB, a sectional view taken along a line VC-VC, and a sectional view taken along a line VD-VD respectively. In FIG. 2, the outer shape of the gas discharge member 22 arranged on the upper surface of the flow passage member 21 described later on is depicted by alternate long and short dash lines, and the gas discharge passage 50 formed in the gas discharge member 22 is depicted by two-dot chain lines. Actually, the outer edges of the gas discharge member 22, which are disposed on the upper side and the both left and right sides shown in FIG. 2, are disposed at the positions overlapped with the outer edges of the flow passage member 21 as viewed in a plan view. However, in order to illustrate the outer shape of the gas discharge member 22 more comprehensively, the outer shape of the gas discharge member 22 is depicted to be one size smaller than the actual size in FIG. 2.

As shown in FIGS. 2 to 5, the subtank 4 has the flow passage member 21 which is arranged on the upper surface of the ink-jet head 3, and the gas discharge member 22 which is arranged on the upper surface of the flow passage member 21. Ink flow passages, through which the inks supplied from the ink cartridges 6 are supplied to the ink-jet head 3, are formed in the flow passage member 21. Gas discharge passages, which are provided to discharge the gas contained in the ink flow passages of the flow passage member 21 to the outside, are formed in the gas discharge member 22.

Those formed as the ink flow passages in the flow passage member 21 include ink storage chambers 34*a* to 34*d*, ink supply ports 31*a* to 31*d*, ink inflow passages 32*a* to 32*d*, and ink outflow passages 33*a* to 33*d*.

Each of the ink storage chambers 34*a* to 34*d* has a substantially rectangular shape as viewed in a plan view. The ink storage chambers 34*a* to 34*d* are arranged in an order of 34*b*, 34*a*, 34*d*, 34*c* from the top in the vertical direction (upward-downward direction as shown in FIGS. 5A to 5D). The ink storage chambers 34*a*, 34*b* and the ink storage chambers 34*c*, 34*d* are partitioned by partition walls 38, 39 respectively.

Damper films 37*b*, 37*d* are stuck to the upper ends of the ink storage chambers 34*b*, 34*d* respectively. The damper films 37*b*, 37*d* function as the walls for defining the upper surfaces of the ink storage chambers 34*b*, 34*d*. Further, damper films 37*a*, 37*c* are stuck to the lower ends of the ink storage chambers 34*a*, 34*c* respectively. The damper films 37*a*, 37*c* function as the walls for defining the lower surfaces of the ink storage chambers 34*a*, 34*c*.

The inks are supplied from the ink inflow passages 32*a* to 32*d* respectively to the ink storage chambers 34*a* to 34*d*. The inks, which are stored in the ink storage chambers 34*a* to 34*d*, are supplied to the ink-jet head 3 via the ink outflow passages 33*a* to 33*d* respectively.

When the printing is performed with the printer 1, the carriage 2 makes the reciprocating movement in the scanning direction by repeating the movement in the rightward direction and the movement in the leftward direction as shown in FIG. 1 as described above. The carriage 2 is once stopped to change the direction of movement, when the carriage 2 changes the direction of the movement from the rightward direction to the leftward direction, or from the leftward direction to the rightward direction.

As described above, the tubes 5 are connected to the subtank 4 from the left side as shown in FIG. 1. Therefore, when the carriage 2 is stopped after the carriage 2 is moved in the rightward direction and when the carriage 2 starts the movement in the leftward direction after the stopped state, then the inks contained in the tubes 5 are moved in the rightward direction due to the inertial force, the inks are allowed to inflow into the subtank 4, and the pressures in the ink storage chambers 34*a* to 34*d* are increased.

On the other hand, when the carriage 2 is stopped after the carriage 2 is moved in the leftward direction and when the carriage 2 starts the movement in the rightward direction after the stopped state, then the inks contained in the tubes 5 are moved in the leftward direction due to the inertial force, the inks contained in the subtank 4 are allowed to outflow to the tubes 5, and thus the pressures in the ink storage chambers 34*a* to 34*d* are lowered.

However, in this embodiment, parts of the walls of the ink storage chambers 34*a* to 34*d* are the damper films 37*a* to 37*d*. Therefore, when the pressure fluctuation arises in the inks contained in the ink storage chambers 34*a* to 34*d* as described above, the pressure fluctuation is suppressed by the deformation of the damper films 37*a* to 37*d*.

The ink supply ports 31*a* to 31*d* are arranged at substantially equal intervals in the upward-downward direction in FIG. 1 in the vicinity of the lower-right end of the flow passage member 21 as shown in FIG. 2. The tubes 5 described above are connected to the ink supply ports 31*a* to 31*d* respectively. Accordingly, the inks of black, yellow, cyan, and magenta are supplied from the ink cartridges 6 to the ink supply ports 31*a* to 31*d* respectively.

The ink inflow flow passages 32*a* to 32*d* have convergent sections (close sections) 41*a* to 41*d* and separative sections (separate sections) 42*a* to 42*d* respectively. The convergent section 41*a* is communicated with the ink supply port 31*a*. The convergent section 41*a* extends from the ink supply port 31*a* upwardly as viewed in FIG. 2. The convergent sections 41*b* to 41*d* are communicated with the ink supply ports 31*b* to 31*d* respectively. The convergent sections 41*b* to 41*d* extend from the ink supply ports 31*b* to 31*d* leftwardly as viewed in FIG. 2, and they are bent substantially perpendicularly at intermediate positions to extend upwardly as viewed in FIG. 2. In other words, the convergent sections 41*a* to 41*d* have the portions which extend in parallel in the upward direction as viewed in FIG. 2.

The portions of the convergent sections 41*a* to 41*d*, which extend in parallel in the upward direction as viewed in FIG. 2, are arranged while being bundled. In other words, the portions are aligned densely substantially at equal intervals in relation to the left-right direction as viewed in FIG. 2. The convergent sections 41*a* to 41*d* are positioned on the same plane or on the identical plane. The upper ends of the convergent sections 41*a* to 41*d* are positioned at approximately the same height as that of the upper end of the ink storage chamber 34*b*. Further, a gas-permeating film 61 is stuck to portions of the convergent sections 41*a* to 41*d* overlapped with the ends disposed on the side opposite to the ink supply ports 31*a* to 31*d* as viewed in a plan view of the upper surface of the flow passage member 21 (upper surface as shown in FIGS. 5A to 5D). The gas-permeating film 61 is the wall for defining the upper surfaces (upper surfaces as viewed in FIGS. 5A to 5D) of the portions of the convergent sections 41*a* to 41*d*. In this arrangement, any ink is not permeated through the gas-permeating film 61, and only the gas is permeated through the gas-permeating film 61. Accordingly, the gas contained in the convergent sections 41*a* to 41*d* is discharged to individual gas discharge chambers 51*a* to 51*d* described later on via the gas-permeating film 61. In this arrangement, owing to the provision of the gas-permeating film 61, the inks contained in the convergent sections 41*a* to 41*d* do not inflow into the individual gas discharge chambers 51*a* to 51*d*.

The convergent sections 41*a* to 41*d* are positioned on the identical plane as described above. Therefore, one gas-permeating film 61 can be used to form the walls for defining the upper surfaces of the convergent sections 41*a* to 41*d*. Accordingly, it is unnecessary to provide any individual gas-permeating film for each of the convergent sections 41*a* to 41*d*. It is possible to reduce the production cost of the subtank 4.

The separative section 42*a* extends to the position adjacent to the ink storage chambers 34*a* to 34*d* as viewed in a plan view in the upper-right direction as shown in FIG. 2 from the end of the convergent section 41*a* disposed on the side opposite to the ink supply port 31*a*. The separative section 42*a* is bent downwardly as shown in FIG. 5A to extend to arrive at the same height as that of the ink storage chamber 34*a*. Further, the separative section 42*a* is bent leftwardly as shown in FIG. 5A, and it is connected to the right end portion of the ink storage chamber 34*a*. The separative section 42*b* extends in the upper-right direction as shown in FIG. 2 from the end of the convergent section 42*b* disposed on the side opposite to the ink supply port 31*b*, and it is connected to the right end portion of the ink storage chamber 34*a* as shown in FIG. 5B.

The separative section 42*c* extends to the position adjacent to the ink storage chambers 34*a* to 34*d* as viewed in a plan view in the upper-left direction as shown in FIG. 2 from the end of the convergent section 41*c* disposed on the side opposite to the ink supply port 31*c*. The separative section 42*c* is bent downwardly as shown in FIG. 5C to extend to arrive at the same height as that of the ink storage chamber 34*c*. Further, the separative section 42*c* is bent leftwardly as shown in FIG. 5C, and it is connected to the right end portion of the ink storage chamber 34*c*. The separative section 42*d* extends to the position adjacent to the ink storage chambers 34*a* to 34*d* as viewed in a plan view in the upper-left direction as shown in FIG. 2 from the end of the convergent section 41*d* disposed on the side opposite to the ink supply port 31*d*. The separative section 42*d* is bent downwardly as shown in FIG. 5D to extend to arrive at the same height as that of the ink storage chamber 34*d*. Further, the separative section 42*d* is bent leftwardly as shown in FIG. 5D, and it is connected to the right end portion of the ink storage chamber 34*d*. That is, the separative sections 42*a* to 42*d* are mutually branched from the convergent sections 41*a* to 41*d*, and they are connected to the ink storage chambers 34*a* to 34*d* respectively.

The ink outflow passages 33*a* to 33*d* have separative sections (separate sections) 43*a* to 43*d* and convergent sections (close sections) 44*a* to 44*d* respectively. The separative sections 43*a* to 43*d* are connected to the left end portions of the ink storage chambers 34*a* to 34*d* respectively as shown in FIGS. 5A to 5D. The separative sections 43*a* to 43*d* extend at mutually different heights in the leftward direction as shown in FIGS. 5A to 5D from the left end portions of the ink storage chambers 34*a* to 34*d*. That is, the separative sections 43*a* to 43*d* extend in a state of being mutually separated from the ink storage chambers 34*a* to 34*d*.

The convergent sections 44*a* to 44*d* are disposed adjacently on the left side of the ink storage chambers 34*a* to 34*d* as shown in FIGS. 5A to 5D, and they are arranged while being mutually disposed adjacently (bundled) in the scanning direction. The separative sections 43*a* to 43*d* are connected to the side surfaces of the convergent sections 44*a* to 44*d* extending in the upward-downward direction. The upper ends of the convergent sections 44*a* to 44*d* are positioned at the same heights as those of the convergent sections 41*a* to 41*d* of the ink inflow flow passages 31*a* to 31*d* (they are positioned on the same plane). That is, the convergent sections 44*a* to 44*d* are allowed to extend while being bundled so that the separative sections 43*a* to 43*d* are collected to be mutually positioned on the same plane.

A gas-permeating film 62 is stuck to the upper ends of the convergent sections 44*a* to 44*d*. The gas-permeating film 62 functions as the walls for defining the upper surfaces of the convergent sections 44*a* to 44*d* (upper surfaces as shown in FIGS. 5A to 5E). Accordingly, the gas contained in the convergent sections 44*a* to 44*d* is discharged to individual gas discharge chambers 53*a* to 53*d* as described later on via the gas-permeating film 62. In this arrangement, owing to the provision of the gas-permeating film 62, the inks contained in the convergent sections 44*a* to 44*d* do not inflow into the individual gas discharge chambers 53*a* to 53*d*.

As described above, the upper ends of the convergent sections 44*a* to 44*d* are positioned on the same plane. Therefore, one gas-permeating film 62 can be used to form the walls for defining the upper surfaces of the convergent sections 44*a* to 44*d*. Accordingly, it is unnecessary to provide any individual gas-permeating film for each of the convergent sections 44*a* to 44*d*. It is possible to reduce the production cost of the subtank 4.

Further, the upper ends of the convergent sections 41*a* to 41*d* of the ink inflow passages 32*a* to 32*d* are positioned on the same plane as that of the upper ends of the convergent sections 44*a* to 44*d* of the ink outflow flow passages 33*a* to 33*d*. Further, the ink storage chamber 34*b*, which is included in the ink storage chambers 34*a* to 34*d* and which is positioned at the uppermost position in relation to the vertical direction, has the upper end which is also positioned on the same plane. Therefore, it is easy to stick the gas-permeating films 61, 62 and the damper film 37*b*.

The lower ends of the convergent sections 44*a* to 44*d* are positioned downwardly as compared with the ink storage chamber 34*c*. Ink outflow ports 45*a* to 45*d* are formed at the lower ends of the convergent sections 44*a* to 44*d*. The ink outflow ports 45*a* to 45*d* are connected to ink supply ports 89 of the ink-jet head 3 as described later on. The inks contained in the subtank 4 are supplied from the ink outflow ports 45*a* to 45*d* to the ink-jet head 3.

The gas discharge member 22 is formed with the gas discharge passage 50. The gas discharge passage 50 includes the individual gas discharge chambers 51*a* to 51*d*, 53*a* to 35*d*, the communication holes 52*a* to 52*d*, 54*a* to 54*d*, a common gas discharge chamber 55, and a suction flow passage 56. The individual gas discharge chambers 51*a* to 51*d* are arranged over or above the left ends of the convergent sections 41*a* to 41*d* as shown in FIGS. 5A to 5D, and they are communicated with the convergent sections 41*a* to 41*d* via the gas-permeating film 61 respectively. The communication holes 52*a* to 52*d* extend upwardly from the upper ends of the individual gas discharge chambers 51*a* to 51*d* to the lower end of the common gas discharge chamber 55. The individual gas discharge chambers 51*a* to 51*d* are communicated with the common gas discharge chamber 55 via the communication holes 52*a* to 52*d*.

The individual gas discharge chambers 53*a* to 53*d* are positioned over or above the convergent sections 44*a* to 44*d*, and they have the shapes which are the same as or equivalent to those of the convergent sections 44*a* to 44*d* as viewed in a plan view. The individual gas discharge chambers 53*a* to 53*d* are communicated with the convergent sections 44*a* to 44*d* via the gas-permeating film 62 respectively. The communication holes 54*a* to 54*d* extend upwardly from the upper ends of the individual gas discharge chambers 53*a* to 53*d* to the lower end of the common gas discharge chamber 55. The individual gas discharge chambers 53*a* to 53*d* are communicated with the common gas discharge chamber 55 via the communication holes 54*a* to 54*d*.

The common gas discharge chamber 55 extends continuously over the area overlapped with the individual gas discharge chambers 51*a* to 51*d*, 53*a* to 53*d* and the ink storage chambers 34*a* to 34*d* as viewed in a plan view over or above the individual gas discharge chambers 51*a* to 51*d*, 53*a* to 53*d*. The suction flow passage 56 extends downwardly as viewed in FIG. 2 from the lower end shown in FIG. 2 of the common gas discharge chamber 55. A suction port 56*a* is provided at the forward end thereof. The tube 7 is connected to the suction port 56*a*.

As described above, in the gas discharge passage 50 formed in the gas discharge member 22, the individual gas discharge chambers 51*a* to 51*d*, 53*a* to 53*d*, the communication holes 52*a* to 53*d*, 54*a* to 54*d*, the common gas discharge chamber 55, and the suction flow passage 56 are communicated with each other. The suction pump 10 sucks the gas contained in the gas discharge passage 50 via the tube 7 from the suction port 56*a* in the state in which the tube 7 and the suction pump 10 are connected to one another by means of the switching unit 8.

Next, an explanation will be made about the flows of the inks to be brought about when the inks are supplied from the ink cartridges 6 to the subtank 4, and the inks are supplied from the subtank 4 to the ink-jet head 3.

The inks, with which the ink cartridges 6 are filled, are supplied via the tubes 5 from the ink supply ports 31*a* to 31*d* to the subtank 4. The inks are supplied from the ink supply ports 31*a* to 31*d* to the ink storage chambers 34*a* to 34*d* via the convergent sections 41*a* to 41*d* and the separative sections 42*a* to 43*d* of the ink inflow flow passages 31*a* to 31*d*. In this situation, the convergent sections 41*a* to 41*d* are communicated with the individual gas discharge chambers 51*a* to 51*d* via the gas-permeating film 61. Therefore, when the gas contained in the gas discharge passage 50 is sucked by the suction pump 10, the gas contained in the convergent sections 41*a* to 41*d* is discharged to the individual gas discharge chambers 51*a* to 51*d*.

The inks contained in the ink storage chambers 34*a* to 34*d* are allowed to flow through the separative sections 43*a* to 43*d* and the convergent sections 44*a* to 44*d* of the ink outflow flow passages 33*a* to 33*d*, and the inks are allowed to inflow into the ink supply ports 89 from the ink outflow ports 45*a* to 45*d* formed at the lower ends of the convergent sections 44*a* to 44*d*.

In this situation, the convergent sections 44*a* to 44*d* are communicated with the individual gas discharge chambers 53*a* to 53*d* via the gas-permeating film 62. Therefore, when the gas contained in the gas discharge passage 50 is sucked by the suction pump 10, the gas contained in the convergent sections 44*a* to 44*d* is discharged to the individual gas discharge chambers 53*a* to 53*d*. Therefore, when the inks contained in the convergent sections 44*a* to 44*d* are supplied to the ink-jet head 3, the gas contained in the convergent sections 44*a* to 44*d* is prevented from any inflow into the ink-jet head 3. Accordingly, the ink discharge characteristic is prevented from any fluctuation in the ink-jet head 3.

In order to sufficiently suppress the pressure fluctuation in the ink storage chambers 34*a* to 34*d*, it is necessary to increase the areal sizes of the damper films 37*a* to 37*d*. In the case of the structure of the subtank 4 as in the embodiment of the present invention in which the ink storage chambers 34*a* to 34*d* are arranged in the vertical direction, the upper surfaces or the lower surfaces of the ink storage chambers 34*a* to 34*d* are defined by the damper films 37*a* to 37*d*, and the gas discharge passage 50 is arranged over or above the ink storage chambers 34*a* to 34*d*, if the areal sizes of the damper films 37*a* to 37*d* are increased, then the areal sizes of the portions at which the convergent sections 41*a* to 41*d* and the individual gas discharge chambers 51*a* to 51*d* are communicated with each other and the areal sizes of the portions at which the convergent sections 44*a* to 44*d* and the individual gas discharge chambers 53*a* to 53*d* are communicated with each other are decreased to an extent corresponding thereto.

If the gas-permeating film 61 and the individual gas discharge chambers 51*a* to 51*d* are not provided, and the gas contained in the convergent sections 41*a* to 41*d* is not discharged to the gas discharge passage 50, then the gas contained in the convergent sections 44*a* to 44*d* cannot be sufficiently discharged to the individual gas discharge chambers 53*a* to 53*d*, because the areal sizes of the portions at which the individual gas discharge chambers 53*a* to 53*d* and the convergent sections 44*a* to 44*d* of the ink outflow flow passages 33*a* to 33*d* are communicated with each other are small. Therefore, when the inks are supplied from the convergent sections 44*a* to 44*d* to the ink-jet head 3, the gas contained in the convergent sections 44*a* to 44*d* consequently flows into the ink-jet head 3. It is feared that the ink discharge characteristic may be fluctuated in the ink-jet head 3.

However, in the embodiment of the present invention, the convergent sections 41*a* to 41*d* are communicated with the individual gas discharge chambers 51*a* to 51*d* via the gas-permeating film 61. Therefore, the gas contained in the convergent sections 41*a* to 41*d* is discharged to the individual gas discharge chambers 51*a* to 51*d*. Accordingly, the amount of the gas is increased in the inks which are allowed to inflow into the separative sections 42*a* to 42*d* from the convergent sections 41*a* to 41*d*, i.e., the inks which are allowed inflow into the ink storage chambers 34*a* to 34*d* from the ink inflow flow passages 32*a* to 32*d* and which are allowed to outflow to the ink outflow flow passages 33*a* to 33*d* from the ink storage chambers 34*a* to 34*d*.

Therefore, even when the areal sizes of the portions at which the convergent sections 44*a* to 44*d* and the individual gas discharge chambers 53*a* to 53*d* are communicated with each other are small, and the gas is discharged in the small amount from the convergent sections 44*a* to 44*d* to the individual gas discharge chambers 53*a* to 53*d*, then the gas contained in the convergent sections 44*a* to 44*d* can be sufficiently discharged to the individual gas discharge chambers 53*a* to 53*d*. It is possible to reliably avoid the inflow of the gas into the ink-jet head 3 from the convergent sections 44*a* to 44*d*.

Figure 6:
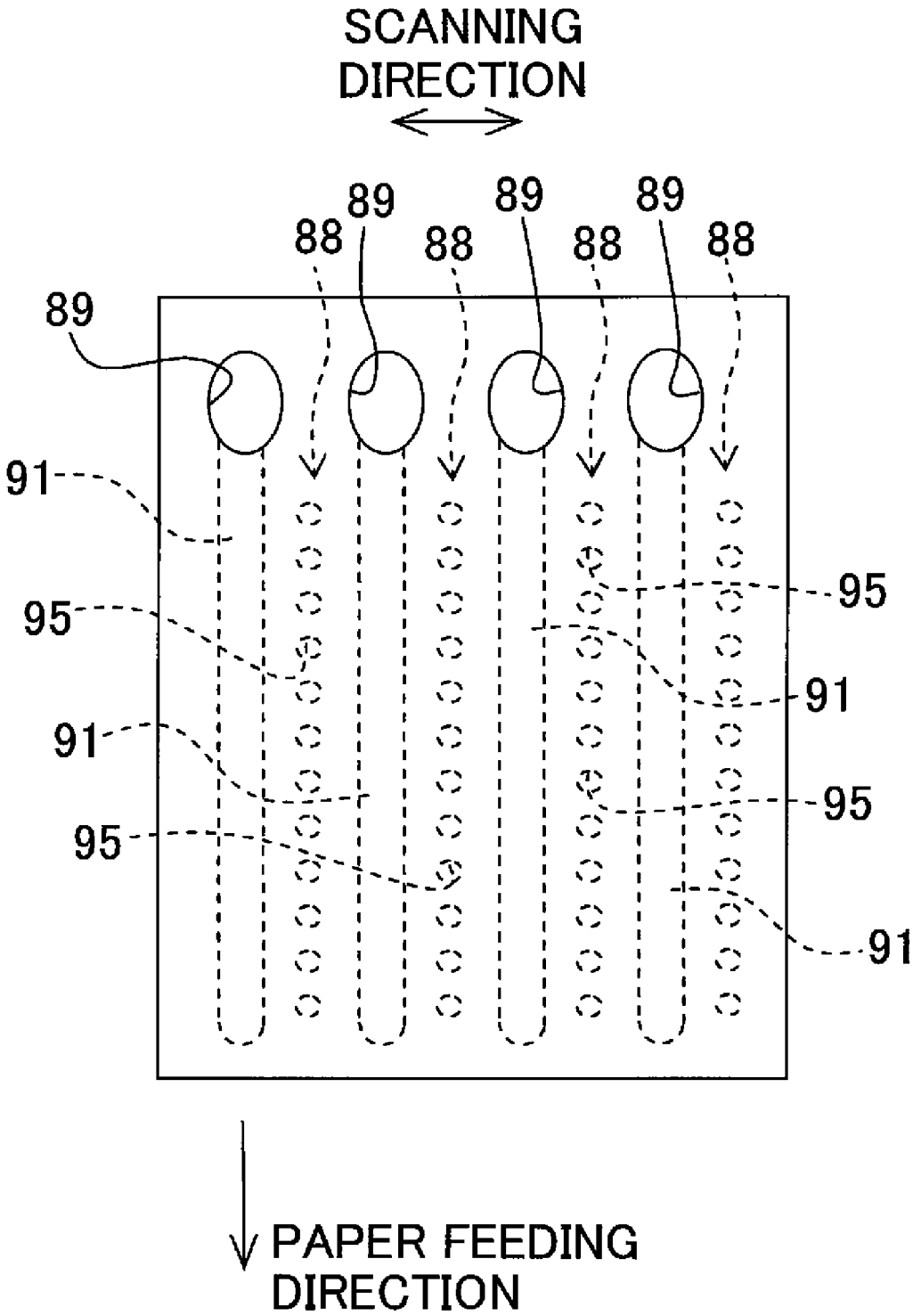
FIG. 6 shows a plan view illustrating an ink-jet head shown in FIG. 1.
Figure 7:
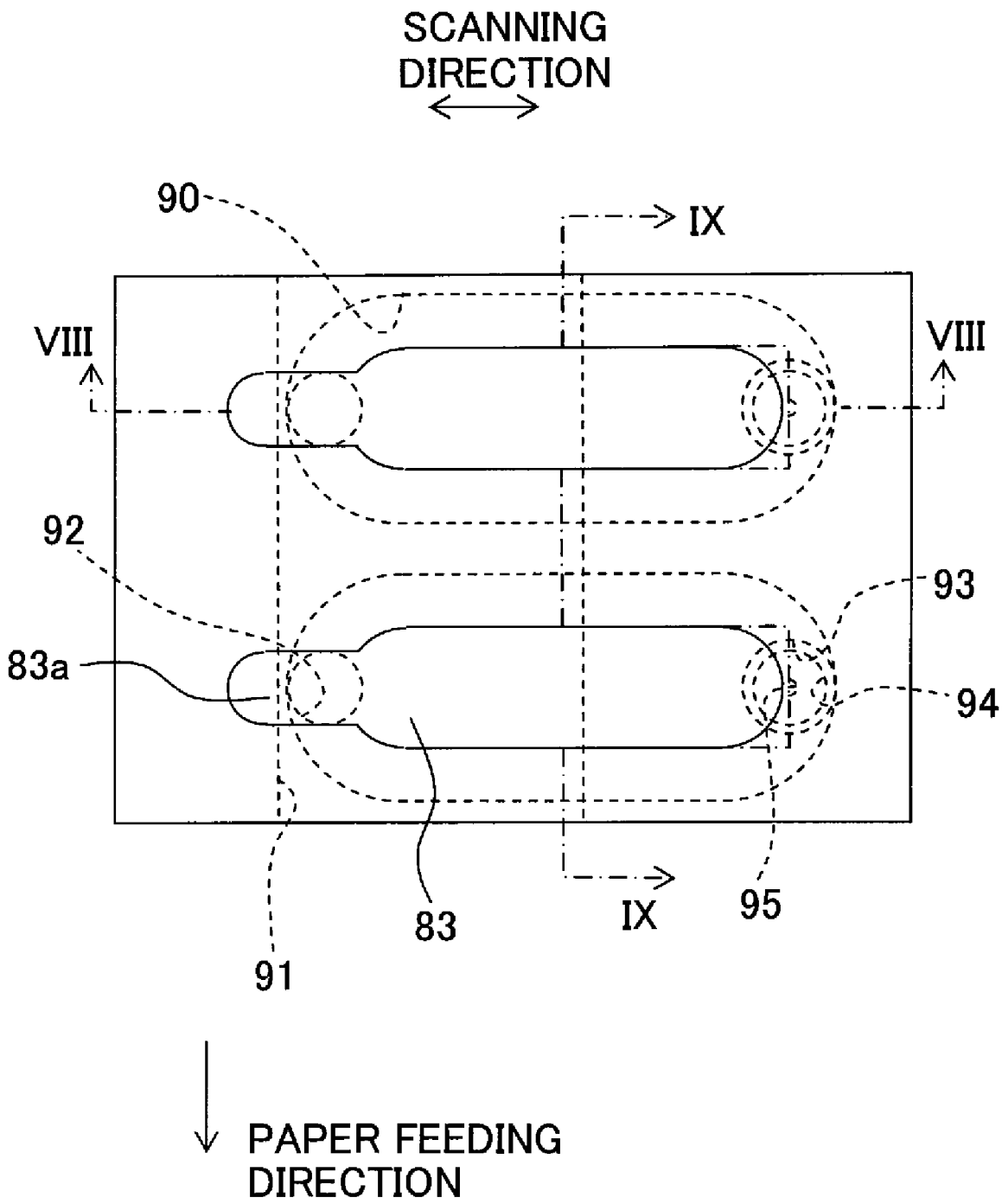
FIG. 7 shows a partial magnified view illustrating those shown in FIG. 6.
Figure 8:
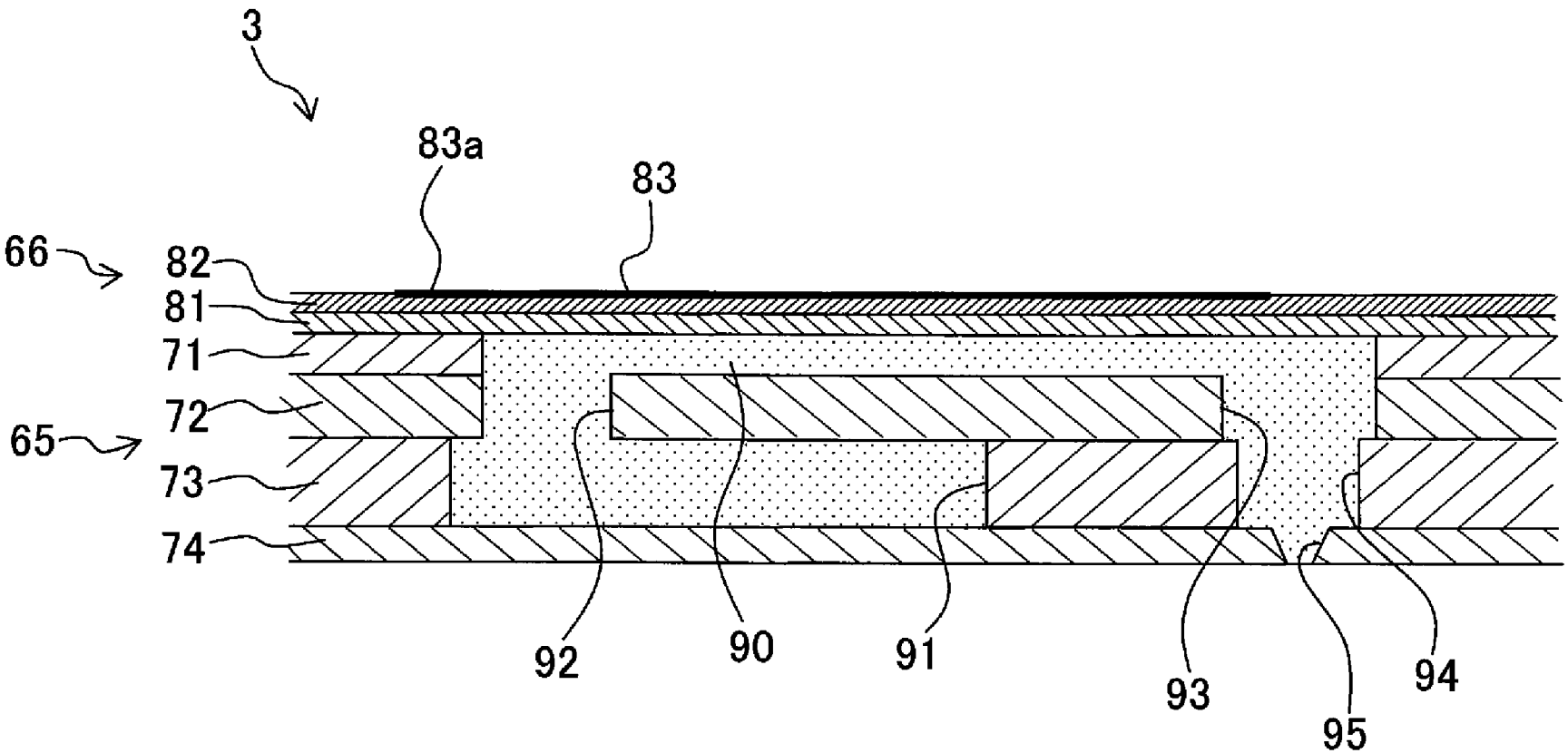
FIG. 8 shows a sectional view taken along a line VIII-VIII shown in FIG. 7.
Figure 9:
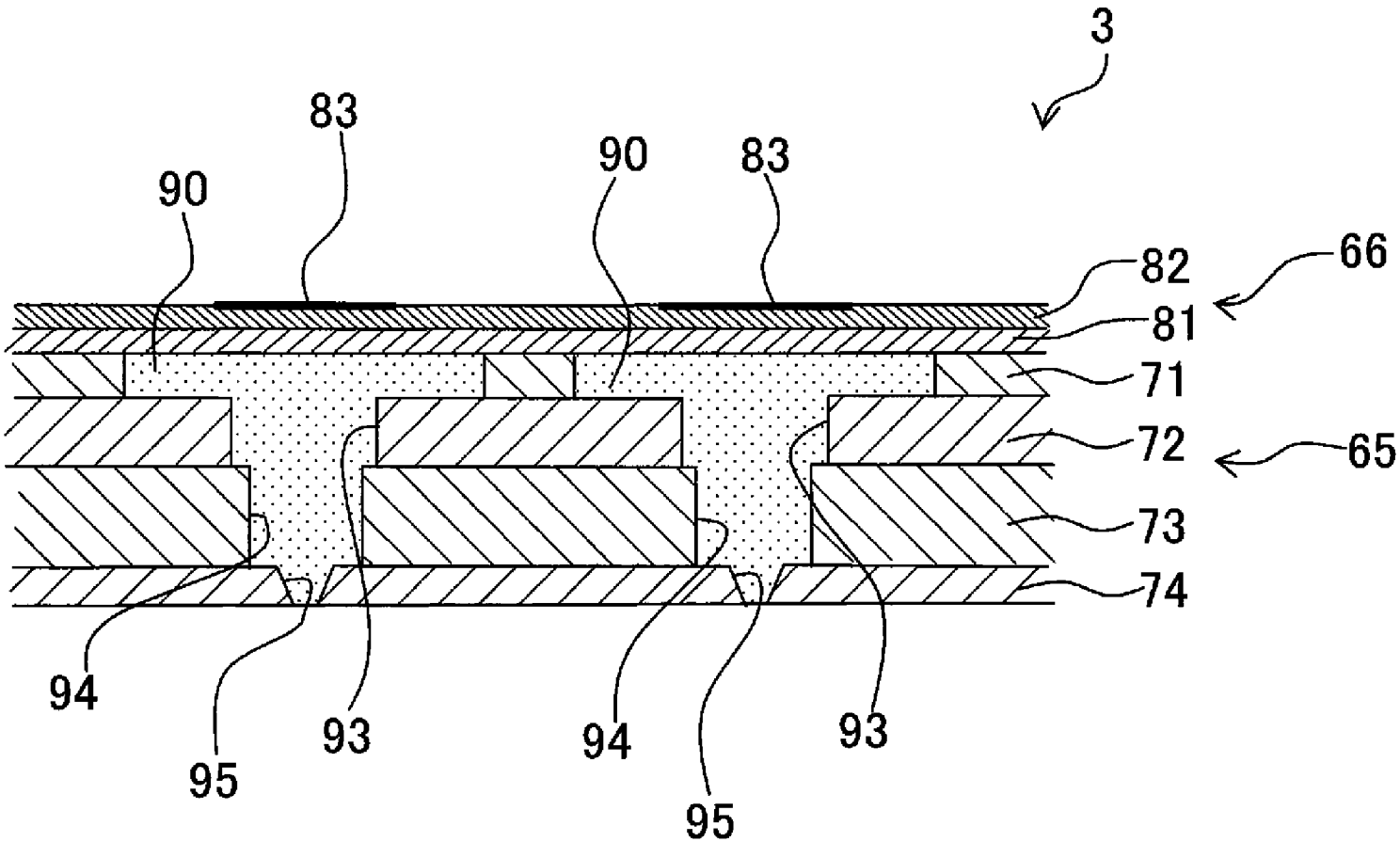
FIG. 9 shows a sectional view taken along a line IX-IX shown in FIG. 7.
Figure 10A:
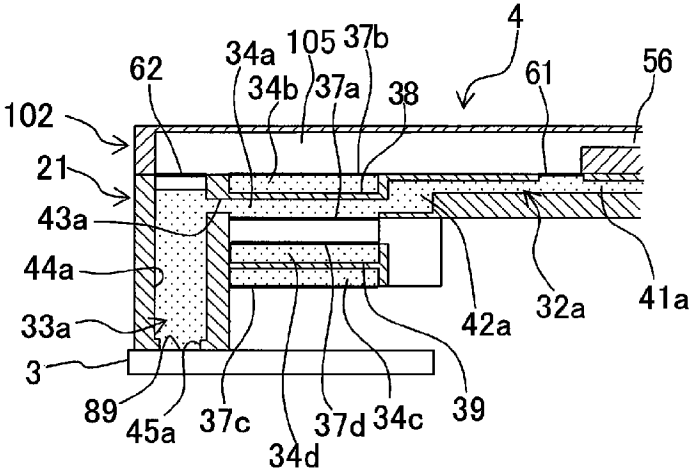
FIGS. 10A, 10B, 10C and 10D show sectional views in relation to a first modified embodiment corresponding to FIGS. 5A to 5D, respectively.
Figure 10B:
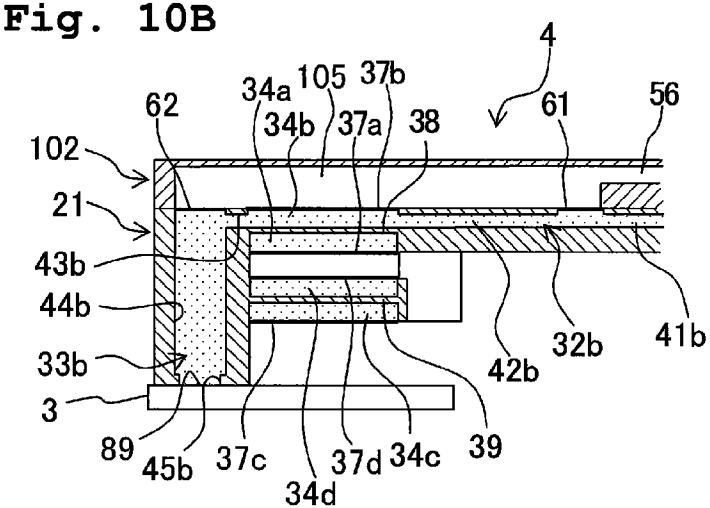
Figure 10C:
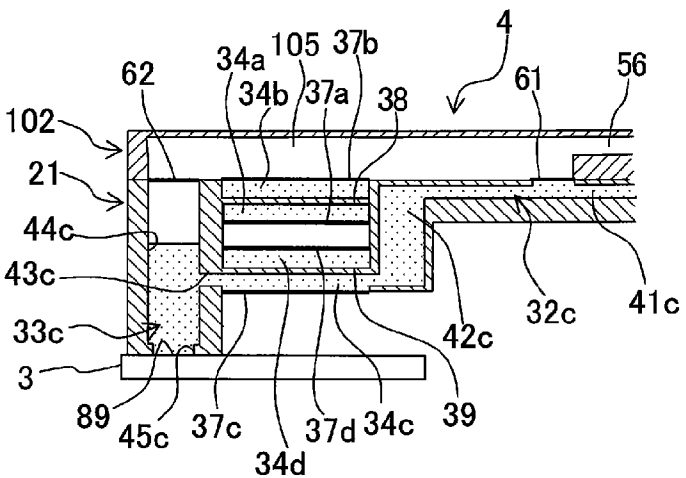
Figure 10D:
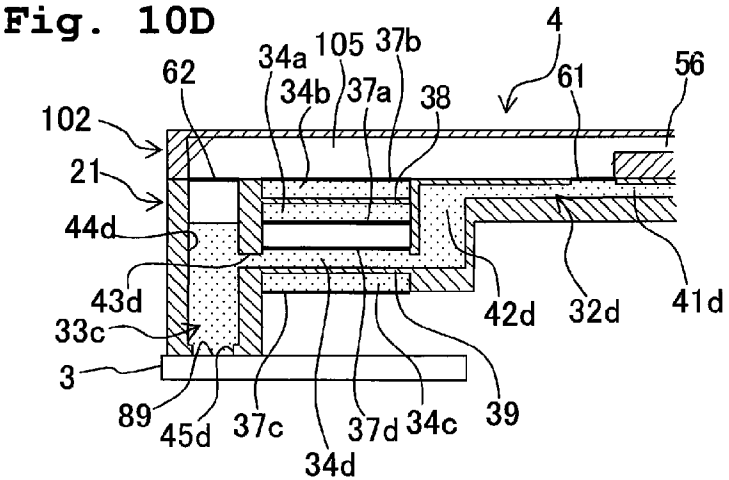

Next, the ink-jet head 3 will be explained. FIG. 6 shows a plan view illustrating the ink-jet head 3 shown in FIG. 1. FIG. 7 shows a partial magnified view illustrating those shown in FIG. 6. FIG. 8 shows a sectional view taken along a line VIII-VIII shown in FIG. 7. FIG. 9 shows a sectional view taken along a line IX-IX shown in FIG. 7. However, in order to understand the drawings more comprehensively, pressure chamber 90 and through-holes 92 to 94 described later on are omitted from the illustration in FIG. 6, and the nozzles 95 are illustrated as those which are larger than actual sizes.

As shown in FIGS. 6 to 9, the ink-jet head 3 has a flow passage unit 65 in which the ink flow passages including, for example, the pressure chambers 90 are formed, and a piezoelectric actuator 66 which is arranged on the upper surface of the flow passage unit 65.

The flow passage unit 65 includes a cavity plate 71, a base plate 72, a manifold plate 73, and a nozzle plate 74. The four plates 71 to 74 are stacked in this order from the top. Each of the three plates 71 to 74 except for the nozzle plate 74 is composed of a metal material such as stainless steel. The nozzle plate 74 is composed of a synthetic resin material such as polyimide. Alternatively, the nozzle plate 74 may be also formed of a metal material in the same manner as the other three plates 71 to 73.

Nozzle arrays 88, which are aligned in four arrays in the scanning direction (left-right direction as shown in FIG. 6), are formed for the nozzle plate 74. Each of the nozzle arrays 88 has the plurality of nozzles 95 which are aligned in one array in the paper feeding direction (upward-downward direction as shown in FIG. 6). The four nozzle arrays 88 correspond to the inks of the respective colors of black, yellow, cyan, and magenta in an order from the left side as viewed in FIG. 6. The inks of the corresponding colors are discharged from the nozzles 95 included in the nozzle arrays 88 corresponding to the inks of the respective colors.

The plurality of pressure chambers 90 are formed for the cavity plate 71 corresponding to the plurality of nozzles 95. The pressure chamber 90 has a substantially elliptic shape which is elongated in the scanning direction. The pressure chambers 90 are arranged so that the right ends of the pressure chambers 90 are overlapped with the nozzles 95 as viewed in a plan view. The through-holes 92, 93 are formed through the base plate 72 at the positions overlapped with the both ends of the pressure chambers 90 in the longitudinal direction as viewed in a plan view.

Four manifold flow passages 91, which extend in the paper feeding direction on the left side of the nozzle arrays 88, are formed for the manifold plate 73 corresponding to the four nozzle arrays 88. Each of the manifold flow passages 91 is overlapped with a substantially left half portion of the corresponding pressure chamber 90 as viewed in a plan view. The ink supply ports 89 are provided at the upper ends of the respective manifold flow passages 91 as shown in FIG. 6. The ink supply ports 89 are connected to the ink outflow ports 45*a* to 45*d* of the subtank 4 as described above. The inks contained in the subtank 4 are supplied from the ink supply ports 89 to the manifold flow passages 91. The through-holes 94 are formed at the positions overlapped with the through-holes 93 and the nozzles 95 as viewed in a plan view.

In the flow passage unit 65, the manifold flow passages 91 are communicated with the pressure chambers 90 via the through-holes 92, and the pressure chambers 90 are further communicated with the nozzles 95 via the through-holes 93, 94. In this way, the plurality of individual ink flow passages, which range from the outlets of the manifold flow passages 91 via the pressure chambers 90 to arrive at the nozzles 95, are formed in the flow passage unit 65.

The piezoelectric actuator 66 has a vibration plate 81, a piezoelectric layer 82, and a plurality of individual electrodes 83. The vibration plate 81 is composed of a conductive material such as a metal material. The vibration plate 81 is joined to the upper surface of the cavity plate 71 to cover the plurality of pressure chambers 90. The conductive vibration plate 81 also serves as the common electrode which is provided to allow the electric field to act on the portions of the piezoelectric layer 83 arranged between the individual electrodes 83 and the vibration plate 81. The vibration plate 81 is connected to an unillustrated driver IC, and it is always retained at the ground electric potential.

The piezoelectric layer 82 is a mixed crystal of lead titanate and lead zirconate. The piezoelectric layer 82 is composed of a piezoelectric material containing a main component of lead titanate zirconate having the ferroelectric property. The piezoelectric layer 82 is continuously arranged on the upper surface of the vibration plate 81 while ranging over the plurality of pressure chambers 90. The piezoelectric layer 82 is previously polarized in the thickness direction thereof.

The plurality of individual electrodes 83 are provided on the upper surface of the piezoelectric layer 82 while corresponding to the plurality of pressure chambers 90. The individual electrode 83 has a substantially elliptic shape which is one size smaller than the pressure chamber 90. The individual electrodes 83 are arranged at the positions overlapped with the substantially central portions of the pressure chambers 90. One end (left end as viewed in FIG. 7) of the individual electrode 83 in the longitudinal direction extends in the leftward direction to the position at which one end is not overlapped with the pressure chamber 90 as viewed in a plan view. The forward end thereof is a contact 83*a*. The unillustrated driver IC is connected to the contacts 83*a* by an unillustrated wiring member such as a flexible printed circuit (FPC). The driving electric potential is selectively applied to the plurality of individual electrodes 83 by the driver IC.

An explanation will now be made about a method for driving the piezoelectric actuator 66. In the piezoelectric actuator 66, the electric potentials of the plurality of individual electrodes 83 are previously retained at the ground electric potential by the unillustrated driver IC. When the driver IC applies the driving electric potential to any one of the plurality of individual electrodes 83, then the difference in the electric potential is generated between the individual electrode 83 to which the driving electric potential is applied and the vibration plate 81 which serves as the common electrode retained at the ground electric potential, and the electric field is generated in the thickness direction at the driving portion of the piezoelectric layer 83 interposed between the individual electrode 83 and the vibration plate 81. The direction of the electric field is parallel to the direction of polarization of the piezoelectric layer 82. Therefore, the driving portion of the piezoelectric layer 82 is shrunk in the horizontal direction which is perpendicular to the direction of polarization. Accordingly, the portions of the vibration plate 81 and the piezoelectric layer 82 opposed to the pressure chamber 90 corresponding to the individual electrode 83 applied with the driving electric potential are deformed to be convex toward the pressure chamber 90 as a whole, and the volume in the pressure chamber 90 is decreased. Accordingly, the pressure of the ink contained in the pressure chamber 90 is raised, and the ink is discharged from the nozzle 95 communicated with the pressure chamber 90.

According to the embodiment explained above, the convergent sections 41*a* to 41*d* of the ink inflow passages 32*a* to 32*d* are communicated with the individual gas discharge chambers 51*a* to 51*d* via the gas-permeating film 61. Therefore, the gas contained in the convergent sections 41*a* to 41*d* is discharged to the individual gas discharge chambers 51*a* to 51*d*. Further, the convergent sections 44*a* to 44*d* of the ink outflow passages 33*a* to 33*d* are communicated with the individual gas discharge chambers 53*a* to 53*d* via the gas-permeating film 62. Therefore, the gas contained in the convergent sections 44*a* to 44*d* is discharged to the individual gas discharge chambers 53*a* to 53*d*.

As described above, the gas can be discharged to the gas discharge passage 50 from both of the ink inflow passages 32*a* to 32*d* and the ink outflow passages 33*a* to 33*d*. Therefore, a sufficient amount of the gas can be discharged. The gas can be reliably separated from the liquids allowed to inflow/outflow into/from the ink storage chambers 34*a* to 34*d*. Any harmful influence on the discharge characteristic is avoided, which would be otherwise caused by the invasion of the gas into the ink-jet head 3. Further, the gas-permeating films 61, 62 do not define the ink storage chambers 34*a* to 34*d*. Therefore, it is possible to secure the sufficient areal sizes of the damper films 37*a* to 37*d* which define the ink storage chambers 34*a* to 34*d*. It is possible to sufficiently attenuate the pressure fluctuation in the ink storage chambers 34*a* to 34*d*. Therefore, it is possible to reliably suppress the pressure fluctuation generated in the liquids contained in the ink storage chambers 34*a* to 34*d*. It is possible to avoid the deterioration of the discharge characteristic which would be otherwise caused by the pressure fluctuation.

The upper ends of the convergent sections 41*a* to 41*d* and the upper ends of the convergent sections 44*a* to 44*d* are positioned on the same plane respectively. Therefore, one sheet of the gas-permeating film 61 can be used to form the walls for defining the upper surfaces of the convergent sections 41*a* to 41*d*, and one sheet of the gas-permeating film 62 can be used to form the walls for defining the upper surfaces of the convergent sections 44*a* to 44*d*. Accordingly, it is possible to decrease the number of the gas-permeating films as compared with a case in which the gas-permeating films are provided individually for the convergent sections 41*a* to 41*d* and the convergent sections 44*a* to 44*d* respectively. It is possible to reduce the production cost of the subtank 4.

The upper ends of the convergent sections 41*a* to 41*d*, the upper ends of the convergent sections 44*a* to 44*d*, and the upper end of the ink storage chamber 34*b*, to which the gas-permeating films 61, 62 and the damper film 37*b* are stuck respectively, are positioned on the same plane. Therefore, it is easy to stick the gas-permeating films 61, 62 and the damper film 37*b*.

When the carriage 2 makes the reciprocating movement in the scanning direction, the pressure fluctuation is caused in the inks contained in the ink storage chambers 34*a* to 34*d*. However, the damper films 37*a* to 37*d* are provided for the ink storage chambers 34*a* to 34*d* respectively. Therefore, the damper films 37*a* to 37*d* are deformed, and thus it is possible to suppress the pressure fluctuation in the ink storage chambers 34*a* to 34*d*.

Further, the switching unit 8 is provided for the printer 1. Therefore, the switching unit 8 can be used to selectively switch the first state in which the suction pump 10 and the tube 7 are connected to one another and the second state in which the suction pump 10 and the suction cap 9 are connected to one another. The suction pump 10 can be used as the suction pump to suck the gas contained in the gas discharge passage 50. Further, the suction pump 10 can be also used as the suction pump to suck the inks contained in the ink-jet head 3 from the suction cap 9. Therefore, it is unnecessary to provide distinct suction pumps therefor.

Next, an explanation will be made about modified embodiments in which various modifications are applied to the embodiment of the present invention. However, the components or parts, which are constructed in the same manner as those of the embodiment of the present invention, are designated by the same reference numerals, any explanation of which will be appropriately omitted.

In the embodiment of the present invention, the gas discharge passage 50 has the individual gas discharge chambers 51*a* to 51*d* communicated with the convergent sections 41*a* to 41*d* of the ink inflow flow passages 32*a* to 32*d*, and the individual gas discharge chambers 53*a* to 53*d* communicated with the convergent sections 44*a* to 44*d* of the ink outflow flow passages 33*a* to 33*d*. The individual gas discharge chambers are communicated with the common gas discharge chamber 55 via the communication holes 52*a* to 52*d*, 54*a* to 54*d* respectively. However, the gas discharge passage is not limited thereto. Any gas discharge passage, which is constructed in any other way, is also available provided that the gas discharge passage is communicated with the ink inflow flow passages 32*a* to 32*d* and the ink outflow flow passages 33*a* to 33*d*.

For example, in a first modified embodiment shown in FIG. 10, a gas discharge member 102 is provided with one common gas discharge chamber 105 which continuously extends over the area overlapped with the gas-permeating films 61, 62 and the damper films 37*a* to 37*d* as viewed in a plan view. Even in this case, the gas contained in the convergent sections 41*a* to 41*d* of the ink inflow flow passages 32*a* to 32*d* is permeated through the gas-permeating film 61, and the gas is discharged to the common gas discharge chamber 105. The gas contained in the convergent sections 44*a* to 44*d* of the ink outflow passages 33*a* to 33*d* is permeated through the gas-permeating film 62, and the gas is discharged to the common gas discharge chamber 105. In this case, the common gas discharge chamber 105 and the suction flow passage 56 correspond to the gas discharge passage according to the present invention.

In the embodiment of the present invention, all of the upper ends of the convergent sections 41*a* to 41*d*, the upper ends of the convergent sections 44*a* to 44*d*, and the upper end of the ink storage chamber 34*b* are on the same plane, and the gas-permeating films 61, 62 and the damper film 37*b* are arranged on the same plane. However, these components may be arranged at mutually different heights.

In the embodiment of the present invention, the upper surfaces of the ink storage chambers 34*b*, 34*d* are defined by the damper films 37*b*, 37*d*, and the lower surfaces of the ink storage chambers 34*a*, 34*c* are defined by the damper films 37*a*, 37*c* respectively. However, it is enough that the damper film is provided so that at least one of the upper surface and the lower surface of the ink storage chambers 34*a* to 34*d* are defined.

In the embodiment of the present invention, the upper ends of the convergent sections 41*a* to 41*d* of the ink inflow passages 32*a* to 32*d* and the upper ends of the convergent sections 44*a* to 44*d* of the ink outflow passages 33*a* to 33*d* are positioned on the same plane respectively, and the gas-permeating films 61, 62 are stuck to the upper ends of the convergent sections 41*a* to 41*d* and the convergent sections 44*a* to 44*d* respectively. However, the ink inflow passages 32*a* to 32*d* may have no portion positioned on the same plane, and parts of the walls of the ink inflow flow passages 32*a* to 32*b* may be constructed by distinct gas-permeating films. Alternatively, the ink outflow passages 33*a* to 33*d* may have no portion positioned on the same plane, and parts of the walls of the ink outflow passages 33*a* to 33*b* may be constructed by distinct gas-permeating films.

In the embodiment of the present invention, the switching mechanism 8 is used to switch the first state in which the suction pump 10 and the tube 7 are connected to one another and the second state in which the suction pump 10 and the suction cap 9 are connected to one another. However, in place of the switching mechanism 8, it is also allowable to independently provide a suction pump to be connected to the tube 7 and a suction pump to be connected to the suction cap 9.

In the embodiment of the present invention, the printer 1 is the printer which has the serial type ink-jet head 3 for performing the printing by discharging the inks from the nozzles 95, while making the reciprocating movement in the scanning direction together with the carriage 2. However, the present invention is also applicable to a printer which has a line type ink-jet head in which nozzles are arranged in the entire region of the recording paper P in relation to the scanning direction.

As for the damper film, for example, it is possible to use a polypropylene (PP) film or a polyethylene (PE) film which has a thickness of about 0.02 mm to 0.2 mm. However, there is no limitation thereto. As for the gas-permeating film, for example, it is possible to use a polytetrafluoroethylene (PTFE) porous film, a polypropylene (PP) porous film, or a polyethylene (PE) porous film which has a thickness of about 0.05 to 0.2 mm. However, there is no limitation thereto. The areal size of the gas-permeating film may be about 3 to 6 $cm^2$. However, there is no limitation thereto. Further, the stacking direction of the ink storage chamber 34*a* to 34*d* is not limited to the vertical direction, and the stacking direction can be directed to an arbitrary direction.

The foregoing description is illustrative of the exemplary case in which the present invention is applied to the subtank provided for the ink-jet head and the printer for performing the printing by discharging the inks from the nozzles. However, there is no limitation thereto. The present invention is also applicable to any liquid supply apparatus for supplying any liquid other than the ink, and any liquid discharge apparatus for discharging any liquid other than the ink. For example, the present invention is applicable to various liquid discharge apparatuses and liquid supply apparatuses for supplying the liquids in order that a conductive paste is discharged to form a fine wiring pattern on a substrate, an organic light-emitting material is discharged onto a substrate to form a high-definition display, and a transmissive or transparent resin is discharged onto a substrate to form a minute optical device such as an optical waveguide.

The present invention is also applicable to liquid discharge apparatuses for discharging liquids other than the ink including, for example, those for reagents, biological solutions, wiring material solutions, electronic material solutions, refrigerants, and fuels, and liquid supply apparatuses for supplying the liquids as described above.

What is claimed is:

1. A liquid supply apparatus which supplies a liquid to an object, the liquid supply apparatus comprising:

a plurality of liquid storage chambers which are stacked in a predetermined direction;

a plurality of damper films each of which defines one surface of an upper surface and a lower surface of one of the liquid storage chambers in the predetermined direction and each of which suppresses a pressure fluctuation of the liquid contained in the one of liquid storage chambers;

a plurality of liquid inflow passages each of which is communicated with one of the plurality of liquid storage chambers and through each of which the liquid flows into one of the plurality of liquid storage chambers;

a plurality of liquid outflow passages each of which is communicated with one of the liquid storage chambers and through each of which the liquid contained in one of the liquid storage chambers flows toward the object;

a gas discharge passage which is arranged on one side in the predetermined direction of the liquid storage chambers and via which a gas contained in each of the plurality of liquid inflow passages and the plurality of liquid outflow passages is discharged;

a sucking mechanism which sucks the gas contained in the gas discharge passage to discharge the gas to outside of the gas discharge passage;

a plurality of first gas-permeating films each of which partially defines one of the liquid inflow passages and through which only the gas is passable; and a plurality of second gas-permeating films each of which partially defines one of the liquid outflow passages and through which only the gas is passable, wherein the gas discharge passage and each of the liquid inflow flow passages are communicated with each other via one of the first gas-permeating films, and the gas discharge passage and each of the liquid outflow passages are communicated with each other via one of the second gas-permeating films.

2. The liquid supply apparatus according to claim 1, wherein the predetermined direction is a vertical direction, and the gas discharge passage is arranged above the liquid storage chambers.

3. The liquid supply apparatus according to claim 2, wherein the liquid inflow passages have close portions which extend in a direction and are arranged closely to each other on a same plane, and separate portions which are continued from the close portion respectively but arranged to be separate and away from each other and which are connected to the liquid storage chambers respectively; and each of the first gas-permeating films defines one of the liquid inflow passages at one of the close portions of the liquid inflow passages.

4. The liquid supply apparatus according to claim 2, wherein the plurality of liquid outflow passages have separate portions which extend from the liquid storage chambers respectively in a state that the separate portions are separated and away from each other, and close portions which are continued from the separate portions respectively and which extend in a direction and are arranged closely to each other on a same plane; and each of the second gas-permeating films defines one the liquid outflow passages at one of the close portions of the liquid outflow passages.

5. The liquid supply apparatus according to claim 2, wherein the first gas-permeating films and the second gas-permeating films are provided on a same plane.

6. The liquid supply apparatus according to claim 5, wherein an uppermost liquid storage chamber, which is included in the plurality of liquid storage chambers and which is positioned at an uppermost position in the vertical direction, has an upper surface defined by one of the damper films, and the damper film is provided on the same plane as that of the first gas-permeating films and the second gas-permeating films.

7. A liquid discharge apparatus which discharges a liquid, the liquid discharge apparatus comprising:

a head having a plurality of nozzles through which the liquid is discharged;

a plurality of cartridges in each of which the liquid is filled to be supplied to the head; and a liquid supply section which supplies the liquid to the head from each of the plurality of cartridges, the liquid supply section including:

a plurality of liquid storage chambers which are stacked in a predetermined direction;

a plurality of damper films each of which defines one surface of an upper surface and a lower surface of one of the liquid storage chambers in the predetermined direction and each of which suppresses a pressure fluctuation of the liquid contained in one of the liquid storage chambers;

a plurality of liquid inflow passages each of which is communicated with one of the liquid cartridges and one of the liquid storage chambers, and through each of which the liquid filled in one of the liquid cartridges flows into one of the liquid storage chambers;

a plurality of liquid outflow passages each of which is communicated with the head and one of the liquid storage chambers and through each of which the liquid contained in one of the liquid storage chambers flows to the head;

a gas discharge passage which is arranged on one side in the predetermined direction of the liquid storage chambers and via which a gas contained in each of the liquid inflow passages and each of the liquid outflow passages is discharged;

a sucking mechanism which sucks the gas contained in the gas discharge passage to discharge the gas to outside of the gas discharge passage;

a plurality of first gas-permeating films each of which partially defines one of the liquid inflow passages and through each of which only the gas is passable; and a plurality of second gas-permeating films each of which partially defines one of the liquid outflow passages and through each of which only the gas is passable, wherein the gas discharge passage and each of the liquid inflow passages are communicated with each other via one of the first gas-permeating films; and the gas discharge passage and each of the liquid outflow passages are communicated with each other via one of the second gas-permeating films.

8. The liquid discharge apparatus according to claim 7, wherein the predetermined direction is a vertical direction, and the gas discharge passage is arranged above the liquid storage chambers.

9. The liquid discharge apparatus according to claim 8, wherein the liquid supply section is fixed to the head; and the liquid discharge apparatus further comprises a reciprocating mechanism which causes the liquid discharge head to reciprocate in parallel to a horizontal plane.

10. The liquid discharge apparatus according to claim 8, wherein the liquid is an ink, and the liquid discharge apparatus further comprising:

a liquid discharge passage through which the ink contained in the head is discharged; and a switching mechanism which selectively switches the sucking mechanism between a first state in which the sucking mechanism is connected to the gas discharge passage and a second state in which the sucking mechanism is connected to the liquid discharge passage.

11. The liquid discharge apparatus according to claim 9, wherein the liquid outflow flow passages are connected to the head in a direction parallel to the horizontal plane.

12. The liquid discharge apparatus according to claim 8, wherein the plurality of liquid inflow flow passages have close portions which extend in a direction and are arranged close to each other on a same plane, and separate portions which are continued from the close portions but arranged to be away and separate from each other and which are connected to the liquid storage chambers respectively; and each of the first gas-permeating films defines one of the liquid inflow passages at one of the close portions of the liquid inflow passages.

13. The liquid discharge apparatus according to claim 8, wherein the plurality of liquid outflow passages have separate portions which extend from the liquid storage chambers respectively in a state that the separate portions are separated and away from each other, and close portions which are continued from the separative portions respectively are arranged closely to each other and extend in a direction on a same plane; and each of the second gas-permeating films defines the liquid outflow passages at one of the close portions of the liquid outflow passages.

14. The liquid discharge apparatus according to claim 8, wherein the first gas-permeating films and the second gas-permeating films are provided on a same plane.

15. The liquid discharge apparatus according to claim 14, wherein an uppermost liquid storage chamber, which is included in the plurality of liquid storage chambers and which is positioned at an uppermost position in the vertical direction, has an upper surface defined by one of the damper films, and the damper film is provided on the same plane as that of the first gas-permeating films and the second gas-permeating films.

* * * * *